United States Patent [19]

Walker

[11] Patent Number: 4,487,291

[45] Date of Patent: Dec. 11, 1984

[54] SOUND ATTENUATING PARTITION

[75] Inventor: Keith W. Walker, Lake Zurich, Ill.

[73] Assignee: United States Gypsum Company, Chicago, Ill.

[21] Appl. No.: 452,221

[22] Filed: Dec. 22, 1982

[51] Int. Cl.[3] ..... E04B 1/82

[52] U.S. Cl. ..... 181/290

[58] Field of Search ..... 181/284, 287, 290

[56] References Cited

U.S. PATENT DOCUMENTS

| | | | |
|---|---|---|---|
| 1,807,395 | 5/1931 | Ellis | 181/290 X |
| 1,925,453 | 9/1933 | Mazer | 181/290 |
| 2,177,393 | 10/1939 | Parkinson | 181/284 X |
| 3,611,653 | 10/1971 | Zinn | 181/290 X |
| 4,016,234 | 4/1977 | Warren et al. | 181/290 X |

*Primary Examiner*—Donald A. Griffin

*Attorney, Agent, or Firm*—Robert M. Didrick; Robert H. Robinson; Samuel Kurlandsky

[57] ABSTRACT

The sound attenuation of building partitions having a cavity between opposing panels thereof is enhanced by a bowed blanket of mineral fibers in said cavity. The apex of the bow is in compressive contact with one of the panels so that sound waves passing into a panel are dampened before they reach the panel on the opposite side of the partition. The bowed blanket is particularly effective in the frequency range wherein the coincidence effect is troublesome.

9 Claims, 3 Drawing Figures

SOUND ATTENUATING PARTITION

This invention relates to sound attenuating partitions for buildings. It relates particularly to partitions comprising a framework of mutually intersecting sets of parallel framing members and wall panels attached to at least one broad side of the framework so that a cavity bounded by a wall panel and two adjacent parallel framing members is created. The invention relates more particularly to partitions wherein said cavity houses a blanket of mineral fibers as the sound attenuating medium.

Batts of mineral fiber have long been placed in the cavities of building partitions as thermal and acoustical insulation blankets. Demands by the public for better and better noise control have caused architects, construction system engineers and insulation makers to seek improvement through more efficient placement of the partition framing members, incorporation of resilient elements in the partition, and thicker, denser blankets. Suggestions have been made to impart a moderate degree of sound vibration dampening to the wall panel by stuffing the partition cavities with blankets which are thicker than the cavities but this approach has been found wanting for two reasons—bowing of the wall panels and the creation of a structural sound path normal to the partition through the compressed mineral fiber.

Local building codes commonly require that party wall partitions have an STC rating of 50 or better. Such a rating is not achievable in mineral wool filled partitions made with conventional steel studs and single layer wall paneling on each face of the partion except for partitions frames with specially designed steel studs which were positioned with special care. Thus, there still remains a need for improved acoustical performance by mineral fiber blankets.

It is an object of this invention, therefore, to provide a partition system having enhanced sound attenuation properties.

It is a related object to provide a Field Sound Transmission Class 50 partition system having a wooden framework and in which the stud cavities are only half filled by the sound attenuation blankets.

It is a further object of this invention to provide a method for building a partition having enhanced sound attenuation properties without putting a disruptive compressive strain on the wall panel faces of the partition.

These and other objects which will be apparent from the following description and drawings are achieved by bending a mineral fiber blanket into a bow, placing the bowed blanket into the space between two adjacent parallel framing members, securing the distal ends of the bowed blanket to said framing members or to a wall panel already in place on the opposite side of the partition framework, allowing the bow of the blanket to protrude beyond the facial plane of the framework, and attaching a wall panel to the framwork in compressive contact with the apex of the bow and its immediately adjacent areas, leaving portions of the blanket on both sides of the apex spaced apart from the wall panel. Thus, sound energy structurally transmitted from one face panel must travel along the plane of the blanket for a distance equal to one-half of the width of the blanket before it reaches the panel on the opposite side of the partition. Transmission of the energy through the cross-section of the blanket, an oblique path across the partition, thoroughly dissipates the energy before it reaches the other side of the partition.

The damping thus achieved is particularly effective in the frequency range dominated by the so-called coincidence effect. This effect occurs when the wavelength of a longitudinal sound wave induced in a wall panel is equal to the length of an airborne sound wave approaching the panel at an oblique angle. Such waves are said to be coincident and there is an efficient transfer of energy between the two mediums. A panel used as a sound barrier between two enclosed spaces is a poor insulator at frequencies approaching the coincidence region. The critical frequency range for gypsum panels is from about 1600 Hz to about 4000 Hz.

The partitions may be walls or ceilings. Thus the term "parallel framing members", as used herein, may refer to studs or joists and the cross members will be the top and bottom plates. For the sake of convenience, further description of the invention will refer to a wall of the studs and plates which make up the framework of such a partition.

The invention will be understood more fully by reference to the accompanying drawings which illustrate partitions having the novel placement of a sound attenuation blanket in the cavity.

Figure 1:
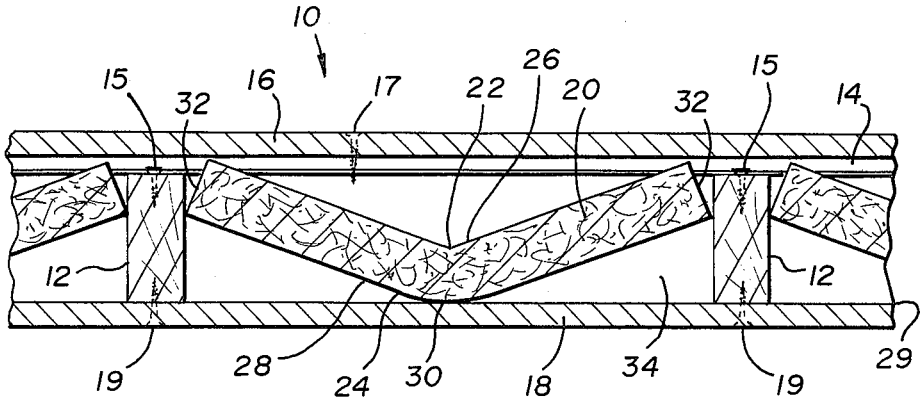
FIG. 1 is a plan view, in section, of a segment of a partition of this invention.

In FIG. 1, the partition 10 comprises upright studs 12, a resilient channel 14 which traverses the studs 12 and which is fastened to said studs with the screws 15, a first panel 16 attached to the resilient channel 14 with the screws 17, a second panel 18 attached to the studs 12 with screws 19, and a mineral fiber sound attenuating blanket 20 which has a longitudinal crease 22 and a transverse bow 24 imposed upon it. The blanket 20 thus has a concave surface 26 and a convex surface 28, respecitvely. The bow 24 protrudes slightly beyond the facial plane 29 of the studs 12 and for that reason it is slightly compressed by the panel 18 at the apex 30 and the immediately adjacent areas of the bow 24. Frictional engagement of the lateral edges 32 of the blanket 20 secures the blanket in the cavity 34 of the partition 10.

Figure 2:
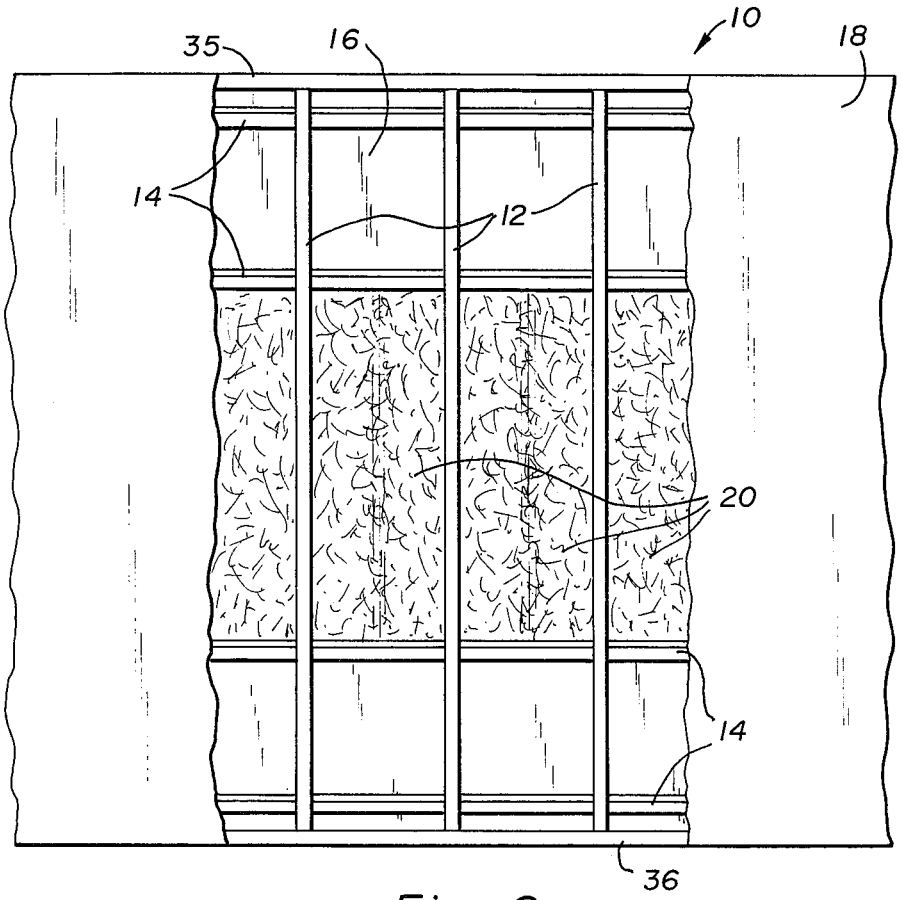
FIG. 2 is a front elevational view of the partition of FIG. 1, partially cut away to show a preferred position of the sound attenuation blanket in the cavity.

In FIG. 2, the panel 18 is attached directly to the studs 12 and plates 35 and 36, whereas the panel 16 is attached to the resilient channels 14. The sound attenuating blanket 20 is centered between the top and bottom of the partition 10 and its length is about one-half of the parition's height. The blanket 20 is tucked between the studs 12 and is bowed toward the observer.

Figure 3:
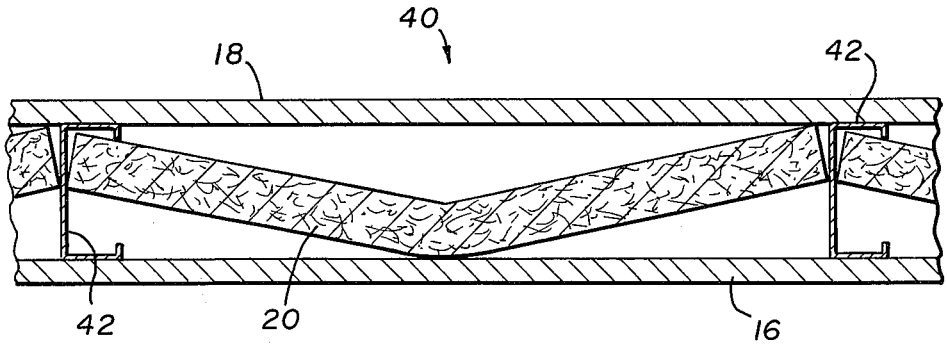
FIG. 3 is a plan view, in section, of a partition having a steel stud framework.

In FIG. 3, the partition 40 is similar to the partition 10 of FIGS. 1 and 2 except that steel studs 42 are used and the panels 16 and 18 are each attached to steel studs 42, the full height of the partition is occupied by the blanket 20, and resilient channels are not used.

The studs and plates may be wood or metal. The commonly used wooden studs are nominally 2"×4" and they are usually placed at 16" o.c. intervals in a partition. The actual space between two adjacent wooden studs is, however, about 14½". Metal studs, on the other hand, are usually spaced apart at 24" o.c. intervals and because the space occupied by their rela-tively thin webs is negligible, the distance between the webs is also 24" for all practical purposes.

The mineral fiber blankets of this invention are preferably from about 1" to about 2" wider than the space between the studs of the partition so that fitting of the blanket between the studs causes bowing of the blanket. The extra width is not essential, however, because a blanket of any width appropriate for the sound attenuating job at hand may be bowed and fastened to the partition by stapling or adhering the lateral edges of the blanket to the interior surface of an in-place panel.

Mineral fibers include those formed from molten rock, blast furnace slag, and glass. Bowing of the mineral fiber blanket is facilitated by creasing it on the concave side and a blanket having sufficient rigidity to accept a crease is preferred for that reason. Batts of fibers spun from molten rock or slag are particularly preferred. Sound attenuation blankets sold by the United States Gypsum Company under its Thermafiber trademark exemplify the preferred blankets of this invention.

The resilient channels 14 shown in FIGS. 1 and 2 are also available from the United Stataes Gypsum Company under the product designation RC-1. Said channel is described in U.S. Pat. No. 4,170,858 which is incorporated herein for the purpose of describing the channel more fully.

The wall panels are exemplified by gypsum panels and cement boards. The panels may be from about ½" to 1" thick. Single or double layers of the panel may be used and the panels may be oriented vertically or horizontally on the partition framework. Single layers are surprisingly effective; for that reason and the savings in cost, single layers are preferred. Gypsum panels having a plaster veneer are contemplated, also.

An 8.6 foot high wall partition 10 and a 7.75 foot high wall parition 40 were tested in general conformance with the ASTM E336-77 Standard Test Method for "Measurement of Sound Insulation in Buildings". The results were classed in strict accordance with the ASTM E413-74 Standard Classification for "Determination of Sound Transmission Class." In each case, the framework was covered on each side by a vertically oriented single layer of ⅝" thick Sheetrock brand Firecode "C" gypsum panels. In parition 10, a Thermafiber blanket 20 (3" thick, density 4 lbs/cu. ft. and 16" wide by 48" long) was used. The wood studs 12 were spaced at 16" o.c. intervals.

In partition 40, the steel studs 42 were spaced at 24" o.c. intervals and two THERMAFIBER blankets 20, each 3" thick by 25" wide by 48" long, were stacked lengthwise in each cavity. The density of the mineral fiber blanket was about 3 lbs./cu. ft.

The temperature and relative humidity of both the source room and the receiving room during the test of said partition 10 were 67° F. and 72%, respectively. For the test of said partition 40 the temperature and relative humidity were 74° F. and 59%, respectively, in each room.

The Field Sound Transmission Class of the partition 10 was 50. The FSTC of the parition 40 was 41. The transmission loss values for the partitions 10 and 40 are given in the following table.

| Frequency (Hz) | Transmission Loss (dB) Partition 10 | Partition 40 |
|---|---|---|
| 100 | 25 | 25 |
| 125 | 26 | 32 |
| 160 | 34 | 32 |
| 200 | 38 | 39 |
| 250 | 42 | 44 |
| 315 | 45 | 48 |
| 400 | 49 | 52 |
| 500 | 49 | 54 |
| 630 | 54 | 57 |
| 1000 | 57 | 60 |
| 1250 | 60 | 62 |
| 1600 | 60 | 62 |
| 2000 | 51 | 53 |
| 2500 | 47 | 47 |
| 3150 | 50 | 49 |
| 4000 | 56 | 50 |

A second test of the partition 40 at a temperature of 75° F. and a R.H. of 52% gave an FSTC of 50.

A partition like that in FIG. 3 except that the blankets were creased lengthwise along the centerline on one side and each half then creased lengthwise again on the other side, thus making four longitudinal quarter sections in each blanket, was tested, also. The temperature was 70° F. and the R.H. was 68%. An FSTC of 51 was obtained.

While the invention has been described with reference to certain specific embodiments, it will be recognized by those skilled in the art that variations are possible which do not depart from the spirit and scope of the claims.

What is claimed is:

1. A parition system having enhanced sound attenuation, said system comprising a framework of spaced-apart, parallel framing members and cross members in co-planar array, a wall panel connected to said framework to form a partition having a cavity therein, and a bowed mineral fiber blanket disposed between adjacent parallel framing members within said cavity, the apex of the bow being in contact with the wall panel, said apex being located along the centerline of the blanket which is parallel to the framing members; said blanket constituting an oblique path across the partition for the dissipation of sound energy, characterized further in that a second wall panel is connected to the opposite side of the framework, a portion of the concave side of the bowed blanket is in contact with the second panel, and the lateral edges of the blanket are in contact with the adjacent parallel framing members.

2. The partition system of claim 1 wherein said blanket is in compressive contact with said wall panels.

3. The partition system of claim 1 wherein said framing members are wooden and a resilient channel is interposed between said wooden framing members and a wall panel forming one boundary of the cavity.

4. The partition system of claim 1 wherein said framing members are wooden, a resilient channel is interposed between said wooden framing members and the wall panels bounding the opposite side of the cavity are attached directly to the wooden framing members.

5. The partition system of claim 4 wherein the apex of the creased blanket and the areas adjacent to said apex are in contact with the wall panel which is attached directly to the wooden framing member.

6. The partition system of claim 1 wherein the framing members are metal and the wall panels on both sides of the cavity are attached directly to the metal framing members.

7. The partition system of claim 1 wherein the length of the creased mineral fiber blanket is about one-half of the length of the cavity.

8. The partition system of claim 1 wherein the blanket is secured in the cavity by frictional engagement with the parallel framing members.

9. In a method for the construction of sound attenuating partitions, said method comprising assembling a plurality of parallel framing members and cross members into a framework, inserting a sound attenuating blanket of mineral fibers between adjacent parallel framing members, and attaching wall panels to the framework, the improvement consisting of creating an oblique path across the partition for the dissipation of sound energy by creasing the blanket longitudinally, placing the creased blanket between adjacent parallel framing members in longitudinal alignment with said framing members, causing the apex of the creased blanket to protrude beyond the facial plane of the framework, and fastening a wall panel to the framework in a compressive relationship with said apex.

* * * * *

UNITED STATES PATENT AND TRADEMARK OFFICE

CERTIFICATE OF CORRECTION

PATENT NO. : 4,487,291

DATED : December 11, 1984

INVENTOR(S) : Keith W. Walker

It is certified that error appears in the above—identified patent and that said Letters Patent is hereby corrected as shown below:

Column 1, line 60, change "framwork" to --framework--

Column 3, line 23, change "Stataes" to -- States --.
line 37, change "parition" to --partition--.
line 45, change "parition" to --partition--.
line 61, change "41" to --51--.

Claim 1, line 1, change "parition" to --partition--.

Claim 4, line 61, after the word "bounding" and before the word "the" insert omitted words --one side of the cavity, and the wall panels bounding--.

Signed and Sealed this

*Thirtieth* Day of *April 1985*

[SEAL]

*Attest:*

DONALD J. QUIGG

*Attesting Officer* *Acting Commissioner of Patents and Trademarks*